US005370028A

United States Patent [19]

Grebe

[11] Patent Number: 5,370,028

[45] Date of Patent: Dec. 6, 1994

[54] STRIP STEEL PUNCHING AND INDENTING TOOL

[75] Inventor: Wolfgang Grebe, Lechbruck, Germany

[73] Assignee: Karl Marbach GmbH & Co., Heilbronn, Germany

[21] Appl. No.: 237,231

[22] Filed: May 2, 1994

Related U.S. Application Data

[63] Continuation of Ser. No. 663,837, Mar. 26, 1991, abandoned.

[30] Foreign Application Priority Data

Aug. 31, 1989 [DE] Germany ..... 3928916

[51] Int. Cl.[5] ..... B26F 1/44; B21K 5/20

[52] U.S. Cl. ..... 83/684; 83/682; 83/695; 76/107.8; 493/61; 493/363

[58] Field of Search ..... 83/652–657, 83/651, 679, 682, 684, 695, 697; 76/107.8; 493/61, 62, 363, 473, 58, 59, 73, 74, 396, 404

[56] References Cited

U.S. PATENT DOCUMENTS

| | | | |
|---|---|---|---|
| 2,899,849 | 8/1959 | Laughter et al. | 76/107.8 |
| 3,059,506 | 10/1962 | Linzell et al. | 76/107.8 |
| 3,062,083 | 11/1962 | Strnad | 83/637 |
| 3,120,601 | 2/1964 | Berlin et al. | 76/107.8 |
| 3,194,090 | 7/1965 | Becker | 76/107.8 |
| 3,373,643 | 3/1968 | Spengler | 83/652 X |
| 4,112,827 | 9/1978 | Kang | 76/107.8 X |
| 4,326,434 | 4/1982 | Mohr et al. | 76/107.8 |
| 4,568,323 | 2/1986 | Roeder | 493/473 |
| 4,729,274 | 3/1988 | Marbach | 83/684 |
| 4,945,798 | 8/1990 | Alphenaar | 83/684 X |
| 4,955,855 | 9/1990 | Saebeller et al. | 76/107.8 X |
| 5,021,042 | 6/1991 | Resnick et al. | 76/107.8 X |

FOREIGN PATENT DOCUMENTS

| | | | |
|---|---|---|---|
| 297324 | 4/1989 | European Pat. Off. . | |
| 3135980 | 6/1983 | Germany | 83/684 |

*Primary Examiner*—Rinaldi I. Rada
*Assistant Examiner*—Clark F. Dexter
*Attorney, Agent, or Firm*—Bromberg & Sunstein

[57] ABSTRACT

A strip steel punching and indenting tool (15) and a method for preparing this type of tool wherein the tool, arranged between a ram (12) and an anvil (14) of a punching machine (10), comprises a supporting plate (16) with slots (18) extending from the lower side of the supporting plate facing the anvil (14) to its upper side facing the ram (12). Each of the slots (18) accommodates a cutter of strip steel for punching (20*a*, 20*b*) and indenting (20*c*), in such a way that the hardened cutting edge (22) of a cutter protrudes from the lower side of the supporting plate (16) and the rounded non-cutting backs (24) thereof face a first intermediate plate (26) of metal mounted on the upper side of the supporting plate. To be able to prepare the punching and indenting tool within a short period of time without impairing the punching performance of the punching machine, the first intermediate plate (26) is between 0.8 and 1.5 mm thick, consists of a metal with a 0.2-tensile yield strength $R_{p0.2}$ of 20 to 90 N/mm$^2$, has a tensile strength $R_m$ of 65 to 150 N/mm$^2$ and a breaking elongation $\delta$ of 3 to 35%. For preparation there is mounted on the first intermediate plate (26) an elastomer plate (28) which is 0.5 to 1.5 mm thick with a hardness of 60 to 100 Shore A and which is replaced by a second metal intermediate plate during normal operation of the punching machine.

25 Claims, 2 Drawing Sheets

STRIP STEEL PUNCHING AND INDENTING TOOL

This is a continuation of copending application(s) Ser. No. 07/663,837 filed on Mar. 26, 1991, now abandoned.

The invention relates to a strip steel punching and indenting tool to be arranged between a ram and an anvil of a punching machine, the tool having a supporting plate in which slots are provided which extend through the thickness thereof, cutters and/or indenting tools of strip steel provided in the slots and having hardened cutting edges or indenting forms protruding therefrom on the side facing the anvil, a first intermediate plate of metal being provided on the side of the supporting plate facing the ram and where the non-cutting backs of the cutters or indenting tools abut, and with an intermediate layer provided on the side of the first intermediate plate of metal facing the ram.

The invention further relates to a method of preparing or dressing this type of strip steel punching and indenting tool, wherein a first intermediate plate of metal bearing an intermediate layer is provided on the upper side of the supporting plate, cardboard is put on the anvil and, in preparation the supporting plate is moved by means of the ram in the direction of the anvil sufficiently far so that the cutting edges of all cutters contact the anvil and/or the indenting tools rest on the cardboard whereas the non-cutting backs thereof are supported by the first intermediate plate.

In the strip steel punching tool known from German Patent 33 17 777 Cl the non-cutting backs of the cutters are also formed as hardened cutting edges. On the upper side of the supporting plate a plate is provided as an intermediate plate which is made of a metal which is softer compared to the hardness of the cutting edge. When the supporting plate is moved downwards and the cutting edge of a cutter protruding from the lower side of the supporting plate contacts the anvil, the hardened edge of the non-cutting back of the cutting blade contacts the intermediate plate and penetrates the plate as the supporting plate is moved further down. For preparation, the supporting plate is moved downwards sufficiently far so that all cutting edges of the cutters protruding from the lower side of the supporting plate are uniformly loaded. The production of cutters used in the known strip steel punching tool is very demanding and expensive owing to the necessary preparation of the cutting edges and the hardening thereof. The dynamic stresses occurring during the punching process further cause fatigue fractures because of high notch stresses at the points of the intermediate plate where the hardened edges of the non-cutting backs of the cutters penetrate after a relatively low number of strokes of the punching machine; thus requiring a new preparation with another intermediate plate.

It is known from the magazine "The Cutting Edge", January 1989, page 12, to provide between the supporting plate and the ram, a plate of a deformable synthetic material into which the non-cutting backs of the cutters can penetrate during the preparation step. After preparation, the plate is removed and hardened under UV light. In order to protect the cutters it is further proposed to provide an elastomer plate between the synthetic plate and the supporting plate. Neither the hardened synthetic plate nor the elastomer plate can resist the dynamic pulsating stresses occurring in the punching process with the result that fatigue fractures occur; thus a new elastomer plate and a new intermediate plate is required and also another preparation step.

EP 0 297 324 Al discloses a generic strip steel punching tool which is provided on the supporting plate thereof towards the ram with a thin iron plate, an intermediate layer of a paper sheeting and another plate on the rear side which are arranged above one another. The thickness of the non-cutting backs of the cutters is decreased with respect to the thickness of the cutters, the non-cutting back sections having a reduced thickness being cut on the length of the cutters and bent towards the opposite edges of the slots in the supporting plate. In this way the non-cutting backs penetrate into the metal plate during preparation. The disadvantages of this known arrangement essentially correspond to those described with reference to German Patent 33 17 777 Cl.

The invention is based on the object of developing the generic strip steel punching and indenting tool in such a way that it can be prepared in a punching machine within a short period in time without impairing the punching performance of the punching machine.

Taking the generic strip steel punching and indenting tool as a basis, this object is achieved in that a first intermediate plate of metal is 0.8 to 1.5 mm thick, has a 0.2-tensile yield strength $R_{p0.2}$ of 20 to 90 N/mm$^2$, a tensile strength $R_m$ of 65 to 150 N/mm$^2$ and a breaking elongation $\delta$ of 3% to 35%, in that before the preparation, the intermediate layer is an elastomer plate having a hardness of between 60 to 100 Shore A hardnesses and is between 0.5 and 1.5 mm thick and that after the preparation the intermediate layer is replaced by a correspondingly thick second metal intermediate plate, which is arranged as a substitute of the elastomer plate.

The first intermediate plate may consist of aluminum or copper.

Preferably, the first intermediate plate may consist of one of the following alloys: AlMgSi, AlMg, AlCuMg, AlMn, AlMgMn.

Preferably, the non-cutting backs of the cutters or indenting tools are rounded.

The use of a ductile (expandable and stretchable) first intermediate plate as well as the mounting of the elastomer plate (intermediate layer) on the latter make it possible for the non-cutting backs of the cutters and indenting tools to penetrate the first intermediate plate owing to the pressure exerted on the anvil after the cutting edges or the lower ends of the indenting tools have come into contact with the anvil; the cutting edges of the cutters and/or or the lower ends of the indenting tools are not damaged owing to plastic deformation, and do not cause a notch effect since the working material of the first intermediate plate can extrude into the elastomer plate on the side opposite the non-cutting back. Standardised cutters and indenting tools may be used in which the non-cutting backs are as wide and as hard as the shafts thereof. After preparation, the elastomer plate is replaced by a second metal intermediate plate as a protective sheet in order to ensure an optimum transmission of the pressure force of the ram onto the supporting plate. By means of the preparation according to the invention the strip steel punching and indenting tool according to the invention enables a high number of punching strokes to be performed without fatigue fractures occurring in the first intermediate plate, since the cutters and indenting tools are thoroughly supported with their entire backs in the recess which was formerly embossed against the soft resilient backing.

Rounding of the non-cutting backs prevents notch stresses in the corners of the ductile first intermediate plate deformed by the intruded non-cutting backs and thus fatigue fractures owing to dynamic pulsating stresses are avoided.

With reference to drawings an embodiment of the invention is further explained. In the drawing.

Figure 1:
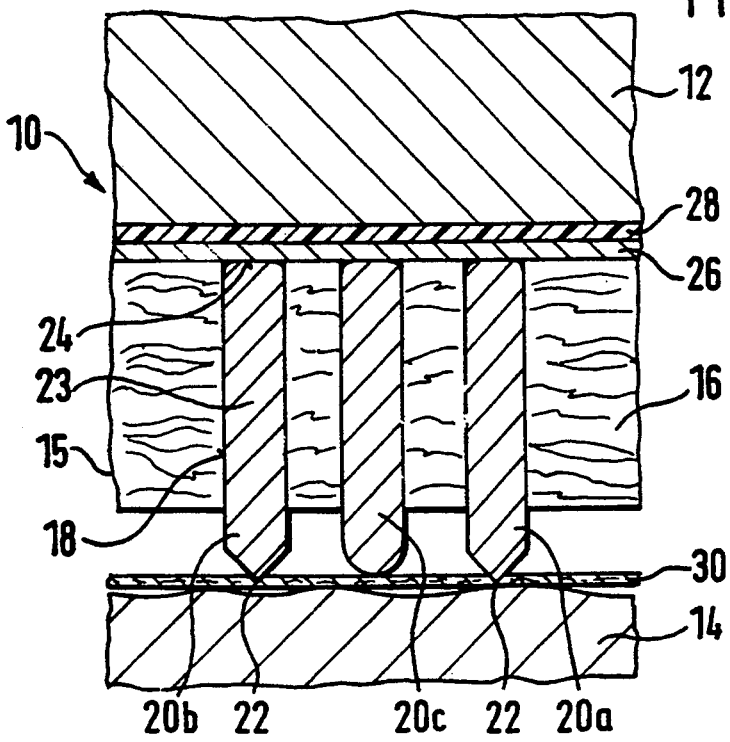
FIG. 1 shows a partial section through a strip steel punching and indenting tool of a punching machine in a first preparing position.
Figure 2:
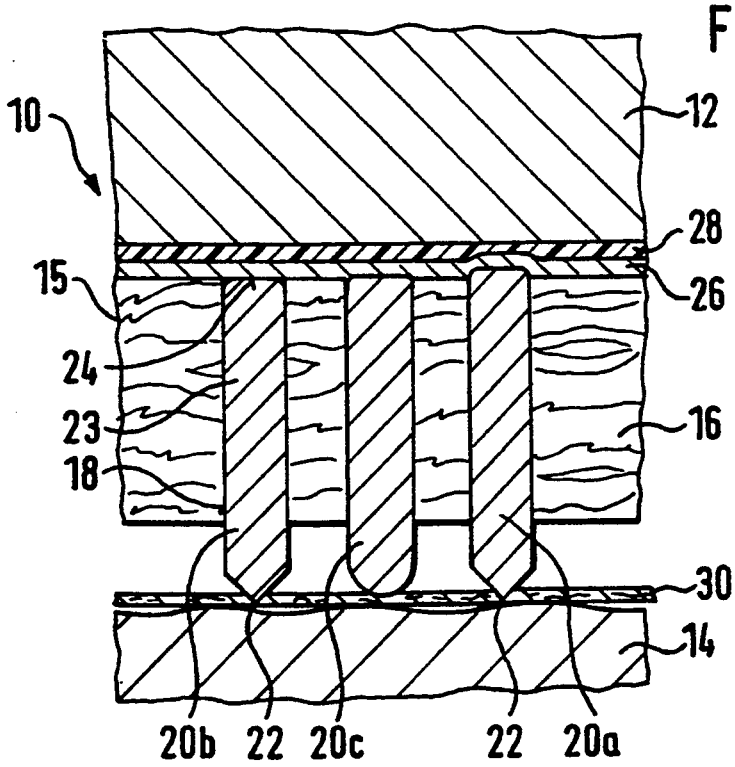
FIG. 2 shows the strip steel punching and indenting tool of FIG. 1 in a second preparing position.

The strip steel punching and indenting tool 15 shown in FIGS. 1 and 2 is arranged between a ram 12 and an anvil 14 of a punching machine 10. The strip steel punching and indenting tool 15 consists of a supporting plate 16 of wood laminate which is arranged horizontally in the punching machine 10 and has vertical slots 18 for accommodating punching cutters **20*a*, 20*b* and indenting tools 20*c* for indenting or grooving, which consist of strip steel. The slots 18 extend from the lower side to the upper side of the supporting plate 16. A first metal intermediate plate 26 which is 1 mm thick and consists of pure aluminum 99.5 G9 is provided on the upper side of the supporting plate 16. This material has a 0.2-tensile yield strength of 60 $N/mm^2$, a tensile strength $R_m$ of 90 $N/mm^2$ and a breaking elongation $\delta$ $A_5$ of 13%. An elastomer plate 28 which is 1 mm thick and has a hardness of 85 SH(A) is provided on this first intermediate plate 26**.

The cutters **20*a*, 20*b* and the indenting tools 20*c* are accommodated in the slots 18 of the supporting plate 16 in such a way that the non-cutting backs 24 thereof face the first intermediate plate 26. The cutting edges 22 of the cutters 20*a*, 20*b* and the rounded ends of the indenting tools 20*c* protrude from the lower side of the supporting plate 16 facing the anvil 14. The cutters 20*a*, 20*b* and the indenting tools 20*c* essentially have a consistent thickness except in the area of the cutting edge 22, i.e. they have the same thickness in the area of the non-cutting edge 24 and of the shaft 23 thereof. In the area of the upper corners the non-cutting back 24 is rounded. The non-cutting back 24** has the same hardness as the shaft.

For preparing the strip steel punching and indenting tool the cutters **20*a*, 20*b* and the indenting tools 20*c* are inserted into the slots 18 of the supporting plate 16 in such a manner that the non-cutting backs 24 thereof abut the first intermediate plate 26 as it is shown in FIG. 1. Cardboard 30 is provided on the anvil 14. Subsequently several preparing strokes are exerted with the punching machine 10 in order to adjust the cutting blades 20*a*, 20*b* in such a way that the cutting edges 22 thereof, when punching, simultaneously cut the cardboard 30 and, being under the same pressure, contact the surface of the anvil 14; this is intended to equalize local unevennesses of the surface of the anvil 14 which is shown in the figures in an exaggerated manner, and on the side of the ram, and to compensate for differences in the height of the cutters, slackness of the plates and possible bending of the ram 12 and of the anvil 14. In the same way this step applies also to the indenting tools 20*c* which are intended not to cut but to emboss the cardboard 30**, and are thus resting on the cardboard surface.

In the case of a preparation stroke the ram 12 together with the strip steel punching and indenting tool 15 is moved towards the anvil 14. When the cutting edge 22 of the cutter **20*a* contacts the anvil 14 and is further moved towards the anvil 14, the non-cutting back 24 indents the first intermediate plate 26. During the preparing strokes the strip steel punching and indenting tool 15 is moved downwards so far that the cutting edges 22 of all strip steel punching cutters 20*a*, 20*b* contact the surface of the anvil 14 in such a way that the cardboard 30 is accurately cut along the entire cutting face. This position is shown in FIG. 2. The indenting tools 20*c* are prepared in the same way apart from the fact that the lower ends of the tools 20*c* indent the cardboard 30** instead of cutting through it.

As the respective non-cutting back 24 indents the first intermediate plate 26, it displaces the ductile material of the first intermediate plate 26 in the direction of the elastomer plate 28. During this the material can evade into the elastomer plate 28 such that the delicate cutting edges 22 of the cutters and the lower end of the indenting tool, respectively, are not damaged by plastic deformation caused by the transmission of force during the step of height equalization. The width of the non-cutting back 24 and the rounding of its corners prevent the material of the first intermediate plate 26 from being torn.

Figure 3:
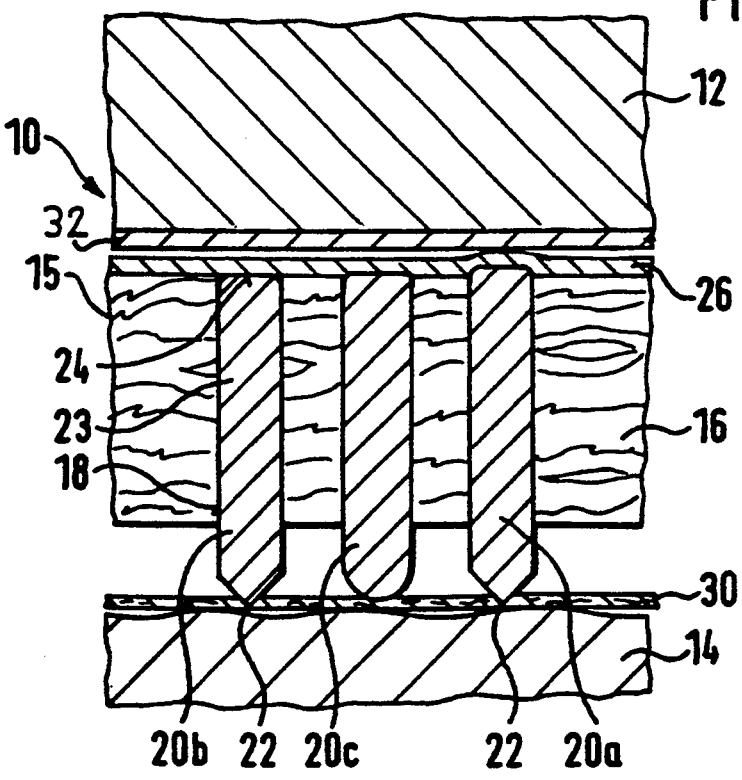
FIG. 3 shows the strip steel punching and indenting tool of FIGS. 1 and 2 after having been fully prepared, wherein the elastomer plate is replaced by a second metal intermediate plate.

When, after a few preparing strokes, the cutters **20*a*, 20*b* and the indenting tools 20*c* are adjusted to the prevailing unevennesses and are exposed to an equal pressure loading, the elastomer plate 28 is replaced by a second metal intermediate plate 32 of the same thickness for normal operation, as shown in FIG. 3. This metal plate may be a protective sheet second metal intermediate commonly used in this type of punching machine 10** or a comparable plate of an aluminum alloy, which can be hardened.

I claim:

1. A punching and indenting tool to be arranged between a ram and an anvil of a punching machine, the tool comprising:

a supporting plate having at least one slot extending through the supporting plate and having first and second sides facing the anvil and the ram respectively;

at least one strip having first and second ends, the strip being located in the slot such that the first end protrudes from the first side of the supporting plate;

an indented first metal intermediate plate located on the second side of the supporting plate, such that the second end of the strip abuts an indented portion of the first intermediate plate, the first metal intermediate plate having been indented at points adjacent the second end of the strip by a preparation stroke while an elastomer plate is placed between the first intermediate plate and the ram, such that the second end of the strip is pressed into the indented portion of the first intermediate plate; and a second metal intermediate plate placed between the first metal intermediate plate and the ram, the second intermediate plate having been inserted in place of the elastomer plate after the preparation stroke.

2. The tool according to claim 1, wherein the strip is made of steel, and the first metal intermediate plate is between 0.8 mm and 1.5 mm thick, and has a 0.2-tensile yield strength $R_{p0.2}$ of 20 to 90 N/mm$^2$, a tensile strength $R_m$ of 65 to 150 N/mm$^2$ and a breaking elongation $\delta$ of 3% to 35%.

3. The tool according to claim 2, wherein the second end of the strip has rounded edges.

4. The tool according to claim 2, wherein the elastomer plate is between 0.5 and 1.5 mm thick and has a hardness of 60 to 100 Shore A hardness.

5. The tool according to claim 2, wherein the first intermediate plate consists of an alloy selected from the group consisting of AlMgSi, AlMg, AlCuMg, AlMn and AlMgMn.

6. The tool according to claim 5, wherein the second end of the strip has rounded edges.

7. The tool according to claim 6, wherein the elastomer plate is between 0.5 and 1.5 mm thick and has a hardness of 60 to 100 Shore A hardness.

8. The tool according to claim 2, wherein, during the indentation of the first metal intermediate plate, cardboard is placed between the first edge of the strip and the anvil prior to the ram and the anvil being moved towards each other.

9. The tool according to claim 2, wherein the first intermediate plate consists of a metal selected from the group consisting of aluminum and copper.

10. The tool according to claim 1, wherein the second end of the strip has rounded edges.

11. The tool according to claim 1, wherein, during the indentation of the first metal intermediate plate, cardboard is placed between the first edge of the strip and the anvil prior to the ram and the anvil being moved towards each other.

12. A tool assembly to be made into a punching and indenting tool, the tool assembly comprising:

a ram;

an anvil;

a supporting plate having at least one slot extending through the supporting plate and having first and second sides facing the anvil and the ram respectively;

at least one strip having first and second ends, the strip being located in the slot such that the first end protrudes from the first side of the supporting plate, wherein a metal intermediate plate is located on the second side of the supporting plate, such that the second end of the strip abuts the intermediate plate; and an elastomer plate located between the metal intermediate plate and the ram, said elastomer plate to be removed and replaced after preparation of the metal intermediate plate by a second metal intermediate plate of the punching and indenting tool.

13. The tool assembly according to claim 12, wherein the strip is made of steel, and the first metal intermediate plate is between 0.8 mm and 1.5 mm thick, and has a 0.2-tensile yield strength $R_{p0.2}$ of 20 to 90 N/mm$^2$, a tensile strength $R_m$ of 65 to 150 N/mm$^2$ and a breaking elongation $\delta$ of 3% to 35%.

14. The tool assembly according to claim 13, wherein the second end of the strip has rounded edges.

15. The tool assembly according to claim 13, wherein the elastomer plate is between 0.5 and 1.5 mm thick and has a hardness of 60 to 100 Shore A hardness.

16. The tool assembly according to claim 13, wherein the first intermediate plate consists of an alloy selected from the group consisting of AlMgSi, AlMg, AlCuMg, AlMn and AlMgMn.

17. The tool assembly according to claim 16, wherein the second end of the strip has rounded edges.

18. The tool assembly according to claim 17, wherein the elastomer plate is between 0.5 and 1.5 mm thick and has a hardness of 60 to 100 Shore A hardness.

19. A punching and indenting tool formed by the steps comprising:

providing a ram;

providing an anvil;

placing a supporting plate between the ram and the anvil, the supporting plate having at least one slot extending through the supporting plate and having first and second sides facing the anvil and the ram respectively;

placing a strip, having first and second ends, in the slot such that the first end protrudes from the first side of the supporting plate;

placing a first metal intermediate plate on the second side of the supporting plate, such that the second end of the strip abuts the first intermediate plate;

placing an elastomer plate between the first metal intermediate plate and the ram;

moving the ram and the anvil towards each other, while the elastomer plate is between the first metal intermediate plate and the ram, so that the strip is pressed by the anvil toward the ram and the second end of the strip is forced against the first metal intermediate plate to create an indentation in the first metal intermediate plate at points adjacent the second end of the strip;

moving the ram and the anvil away from each other; and replacing the elastomer plate, after the indentation is created in the first metal intermediate plate, with a second metal intermediate plate placed between the indented first metal intermediate plate and the ram.

20. The tool according to claim 19, wherein the process of forming the tool further includes the step of placing cardboard on the anvil before the ram is moved toward the anvil.

21. The tool according to claim 19, wherein the strip is made of steel, and the first metal intermediate plate is between 0.8 mm and 1.5 mm thick, and has a 0.2-tensile yield strength $R_{p0.2}$ of 20 to 90 N/mm$^2$, a tensile strength $R_m$ of 65 to 150 N/mm$^2$ and a breaking elongation $\delta$ of 3% to 35%.

22. The tool according to claim 21, wherein the second end of the strip has rounded edges.

23. The tool according to claim 21, wherein the elastomer plate is between 0.5 and 1.5 mm thick and has a hardness of 60 to 100 Shore A hardness.

24. The tool according to claim 21, wherein the first intermediate plate consists of an alloy selected from the group consisting of AlMgSi, AlMg, AlCuMg, AlMn and AlMgMn.

25. The tool according to claim 19, wherein the elastomer plate is between 0.5 and 1.5 mm thick and has a hardness of 60 to 100 Shore A hardness.

* * * * *